US011015833B2

(12) United States Patent
Hong et al.

(10) Patent No.: US 11,015,833 B2
(45) Date of Patent: May 25, 2021

(54) SIZE DETERMINING METHOD AND DEVICE FOR FRESH AIR INLET, AND INDOOR UNIT OF AIR CONDITIONING

(71) Applicants: GD MIDEA HEATING & VENTILATING EQUIPMENT CO., LTD, Foshan (CN); MIDEA GROUP CO., LTD., Foshan (CN)

(72) Inventors: Zhirong Hong, Foshan (CN); Shize Li, Foshan (CN); Yingqiang Mo, Foshan (CN)

(73) Assignees: GD MIDEA HEATING & VENTILATING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 371 days.

(21) Appl. No.: 16/112,509

(22) Filed: Aug. 24, 2018

(65) Prior Publication Data

US 2019/0137135 A1 May 9, 2019

(30) Foreign Application Priority Data

Nov. 6, 2017 (CN) ..... 201711088506.2

(51) Int. Cl.
*F24F 11/74* (2018.01)
*F24F 1/0007* (2019.01)
*F24F 11/63* (2018.01)

(52) U.S. Cl.
CPC ..... *F24F 11/74* (2018.01); *F24F 1/0007* (2013.01); *F24F 11/63* (2018.01)

(58) Field of Classification Search
CPC ..... F24F 11/74; F24F 11/63; F24F 1/007
(Continued)

(56) References Cited

U.S. PATENT DOCUMENTS 7,690,210 B2 * 4/2010 Yamaguchi ..... B60H 1/00849 62/156
2007/0017667 A1 * 1/2007 Weng ..... F24F 11/30 165/214

FOREIGN PATENT DOCUMENTS

CN 1782529 A 6/2006
CN 101382314 A 3/2009
(Continued)

OTHER PUBLICATIONS

Ductulator (Apps on Google Play. (n.d.). Retrieved Dec. 29, 2020 . Note that the release date is Oct. 10, 2015) (Year: 2015).*
(Continued)

*Primary Examiner* — Vivek K Shirsat
(74) *Attorney, Agent, or Firm* — Morgan, Lewis & Bockius LLP

(57) ABSTRACT

The present disclosure provides a method for determining the size of the fresh air inlet performed by a computing device, and an indoor unit of an air conditioner. The computing device acquires an outputting air volume and a fresh air coefficient of the indoor unit of the air conditioner; calculates a cross-sectional area of the fresh air inlet, according to the outputting air volume and the fresh air coefficient of the indoor unit of the air conditioner; and calculates a diameter of the fresh air inlet, according to the cross-sectional area of the fresh air inlet. The indoor unit of the air conditioner having the fresh air inlet can improve the comfort in the indoor environment and user's experience satisfaction without adversely affecting the heat exchange efficiency.

17 Claims, 5 Drawing Sheets

(58) Field of Classification Search
USPC ..... 454/229
See application file for complete search history.

(56) References Cited

FOREIGN PATENT DOCUMENTS

| | | | |
|---|---|---|---|
| CN | 105627435 | A | 6/2016 |
| CN | 206556189 | U | 10/2017 |

OTHER PUBLICATIONS

Office Action, CN201711088506.2, dated Jul. 31, 2019, 16 pgs. -No English Translation Available-.
Midea Group Co. Ltd., Second Office Action, CN201711088506.2, dated Mar. 16, 2020, 13 pgs.
Wang, Xiaolu et al., Heating Ventilation and Air Conditioning Technology, China Building Materials Industry press, ISBN 978-7-5160-1632-9, Sep. 30, 2016, p. 104, 6 pgs.
Wang, Xiaolu et al., Computer Aided Design of Home Central Air Conditioning System, Database Engineering Technology II, No. 1, Jan. 2012, pp. 48-50, 7 pgs.

* cited by examiner

SIZE DETERMINING METHOD AND DEVICE FOR FRESH AIR INLET, AND INDOOR UNIT OF AIR CONDITIONING

PRIORITY CLAIM AND RELATED APPLICATION

This application claims priority to Chinese Patent Application No. 201711088506.2, entitled "SIZE DETERMINING METHOD AND DEVICE FOR FRESH AIR INLET, AND INDOOR UNIT OF AIR CONDITIONING" filed on Nov. 6, 2017, which is hereby incorporated by reference in its entirety.

TECHNICAL FIELD

The present disclosure relates to the field of air conditioner technology, and more particularly to the method and the device for determining the size of the fresh air inlet, and the indoor unit of air conditioner.

BACKGROUND

With the gradual popularization of the air conditioner, the requirement of comfort for the air conditioner, especially the requirement of comfort in the indoor environment, is increased. During working process, the air conditioner carries out the heat exchange cycle mainly by absorbing the indoor air and then releasing the air to the indoor room after heat exchange. However, during the heat exchange process, moisture loss would result in dry indoor air, which makes users uncomfortable. Therefore, if fresh air can be brought into the indoor room from outdoor during the heat exchange process, the indoor environment can be greatly improved to make users more comfortable.

As bringing fresh air into the indoor room may affect the heat exchange efficiency of the indoor unit of the air conditioner, while there is no simple and feasible method for determining the size of the fresh air inlet, such that it is challenging to add the fresh air inlet to the air conditioner, so normally the existing air conditioners define no fresh air inlets. Some indoor unit of the air conditioners are defined with fresh air pipes to bring in fresh air, however, the heat exchange efficiency of the indoor unit of the air conditioner is inevitably reduced.

SUMMARY

The present disclosure is to provide the method for determining the size of the fresh air inlet, the device for determining the size of the fresh air inlet, and the indoor unit of air conditioner, which aim to solve the problem of that there is no method for determining the size of the fresh air inlet and adding the fresh air inlet to the indoor unit of the air conditioner.

In order to achieve the above purpose, the present disclosure provides the method for determining the size of the fresh air inlet, the fresh air inlet is a fresh air inlet of indoor unit of air conditioner, the method includes the following steps:

acquiring an outputting air volume and a fresh air coefficient of the indoor unit of the air conditioner;

calculating a cross-sectional area of the fresh air inlet, according to the outputting air volume and the fresh air coefficient of the indoor unit of the air conditioner; and calculating a diameter of the fresh air inlet, according to the cross-sectional area of the fresh air inlet.

Preferably, the fresh air coefficient includes a maximum fresh air coefficient and a minimum fresh air coefficient, the step of calculating a cross-sectional area of the fresh air inlet according to the outputting air volume and the fresh air coefficient of the indoor unit of the air conditioner includes the following steps:

determining a cross-sectional area range of the fresh air inlet, according to the outputting air volume, the maximum fresh air coefficient, and the minimum fresh air coefficient of the indoor unit of the air conditioner; and defining a cross-sectional area within the cross-sectional area range of the fresh air inlet as the cross-sectional area of the fresh air inlet.

Preferably, the outputting air volume includes a maximum outputting air volume and a minimum outputting air volume, the step of determining the cross-sectional area range of the fresh air inlet, according to the outputting air volume, the maximum fresh air coefficient, and the minimum fresh air coefficient of the indoor unit of the air conditioner includes the following steps:

calculating a first cross-sectional area range of the fresh air inlet according to the maximum outputting air volume, the maximum fresh air coefficient, and the minimum fresh air coefficient of the indoor unit of the air conditioner;

calculating a second cross-sectional area range of the fresh air inlet according to the minimum outputting air volume, the maximum fresh air coefficient, and the minimum fresh air coefficient of the indoor unit of the air conditioner;

judging whether there is an intersection area between the first cross-sectional area range of the fresh air inlet and the second cross-sectional area range of the fresh air inlet; and defining the intersection area as the cross-sectional area range of the fresh air inlet when there is an intersection area.

Preferably, the step of determining the cross-sectional area range of the fresh air inlet, according to the outputting air volume, the maximum fresh air coefficient, and the minimum fresh air coefficient of the indoor unit of the air conditioner further includes the following steps:

defining both the first cross-sectional area range of the fresh air inlet and the second cross-sectional area range of the fresh air inlet as the cross-sectional area range of the fresh air inlet, when there is no intersection area between the first cross-sectional area range of the fresh air inlet and the second cross-sectional area range of the fresh air inlet.

Preferably, the step of defining the cross-sectional area within the cross-sectional area range of the fresh air inlet as the cross-sectional area of the fresh air inlet includes the following steps:

acquiring an intermediate cross-sectional area of the fresh air inlet from the cross-sectional area range of the fresh air inlet; and defining the intermediate cross-sectional area of the fresh air inlet as the cross-sectional area of the fresh air inlet.

In order to achieve the above goal, the present disclosure further provides the indoor unit of air conditioner, which includes a housing, the housing provided with an air outlet and a return air inlet, air flows into the indoor unit of the air conditioner from the return air inlet to perform heat exchange, and is vented from the air outlet, a side wall of defining the return air inlet defines at least one fresh air inlet.

Preferably, the indoor unit of the air conditioner further includes at least one dust-proof member which detachably covers the fresh air inlet.

Preferably, the side wall of defining the return air inlet defines a plurality of fresh air inlets, each of the fresh air inlets having a unique size, and two opposite side walls of the return air inlet respectively define the fresh air inlet.

In order to achieve the above goal, the present disclosure further provides a computing device for determining the size of the fresh air inlet, which includes a processor, a computer-readable storage medium, and a computer program which is stored in the memory and operated by the processor, the computer program performs the above steps of the method for determining the size of the fresh air inlet when is executed by the processor, to calculate the diameter of the fresh air inlet on the indoor unit of the air conditioner.

Preferably, the computer-readable storage medium is a non-transitory computer readable storage medium.

The present disclosure provides the method for determining the size of the fresh air inlet, the device for determining the size of the fresh air inlet, and the indoor unit of the air conditioner, the cross-sectional area of the fresh air inlet is calculated according to the outputting air volume and the fresh air coefficient of the indoor unit of the air conditioner, and then the diameter of the fresh air inlet can be calculated according to the cross-sectional area of the fresh air inlet, such that the acquired size of the fresh air inlet, the obtained fresh air inlet can maximize satisfy user's comfort requirement of the indoor environment. Therefore, the indoor unit of the air conditioner having the fresh air inlet can improve the comfort in the indoor environment and user's experience satisfaction without adversely affecting the heat exchange efficiency.

The realization of the aim, functional characteristics, advantages of the present disclosure are further described specifically with reference to the accompanying drawings and embodiments.

DETAILED DESCRIPTION OF THE EMBODIMENTS

It is to be understood that the embodiments described herein are intended to merely illustrate and not to limit the present disclosure.

The primary technical solution of the exemplary embodiment of the present disclosure is: acquiring an outputting air volume and a fresh air coefficient of indoor unit of air conditioner; calculating a cross-sectional area of the fresh air inlet, according to the outputting air volume and the fresh air coefficient of the indoor unit of the air conditioner; and calculating a diameter of the fresh air inlet, according to the cross-sectional area of the fresh air inlet.

In the prior art, there is no simple and feasible method for determining the size of the fresh air inlet, it is challenging to add the fresh air inlet to the air conditioner, so normally the existing air conditioners define no fresh air inlets. Some indoor units of the air conditioners are defined with fresh air pipes used for bringing fresh air into indoor room, however, the heat exchange efficiency of the indoor unit of the air conditioner is inevitably reduced.

The present disclosure provides the technical solution, which calculates the cross-sectional area of the fresh air inlet according to the outputting air volume and the fresh air coefficient of the indoor unit of the air conditioner; and calculates the diameter of the fresh air inlet according to the cross-sectional area of the fresh air inlet, therefore the size of the fresh air inlet is achieved, and the indoor unit of the air conditioner formed with the fresh air inlet can improve the comfort in the indoor environment and user's experience satisfaction without adversely affecting the heat exchange efficiency.

Figure 1:
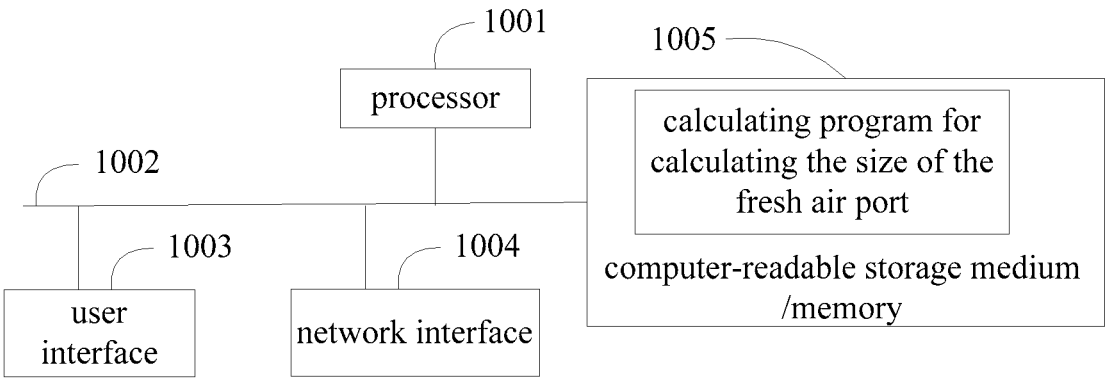
FIG. 1 is a structure diagram of hardware operating environment of terminal/device according to an exemplary embodiment of the present disclosure.

Referring to FIG. 1, FIG. 1 is a structure diagram of hardware operating environment of a computing terminal/device according to an exemplary embodiment of the present disclosure.

The terminal of the exemplary embodiment of the present disclosure can be terminal device having display function, such as, personal computer (PC), smart-phone, tablet computer, portable computer, etc., in addition, the terminal can also be air conditioner.

Referring to FIG. 1, the terminal can includes: processor 1001, such as, central processing unit (CPU), network interface 1004, user interface 1003, computer-readable storage medium 1005, and communication bus 1002. The computer-readable storage medium 1005 can be memory 1005. And, the communication bus 1002 is used for achieving the connection communication among the above members. The user interface 1003 can includes display screen, input unit, such as keyboard, the user interface 1003 can also include standard wired interface, wireless interface (such as a WI-FI interface). The memory 1005 can be high speed random access memory (RAM), or non-volatile memory, such as, disk memory. The memory 1005 can also be memory device which can work independently of the above processor 1001.

It can be understood by persons skilled in the art that, the structure of the terminal shown in FIG. 1 cannot be intended to limit the terminal, can include less members or more components than the members shown in FIG. 1, or include the combination of the some of the members, or includes different arrangement of the members.

Referring to FIG. 1, the memory 1005 defined as storage medium can include operating system, network communication module, user interface module, and control application program of domestic robot.

In the terminal shown in FIG. 1, the network interface 1004 is mainly used for connecting with back-end server, and able to carry out data communication with the back-end server; the user interface 1003 is mainly used for connecting with client side (user side), and able to carry out data communication with the client side; and the processor 1001 is used for calling the control application program of the domestic robot stored in the memory 1005, and executing the following operations:

acquiring the outputting air volume of the indoor unit of the air conditioner and the fresh air coefficient;

calculating a cross-sectional area of the fresh air inlet, according to the outputting air volume and the fresh air coefficient of the indoor unit of the air conditioner; and calculating a diameter of the fresh air inlet, according to the cross-sectional area of the fresh air inlet.

Furthermore, the processor 1001 can also be used for calling network operation control application program stored in the memory 1005, and executing the following operations:

determining a cross-sectional area range of the fresh air inlet, according to the outputting air volume, the maximum fresh air coefficient, and the minimum fresh air coefficient of the indoor unit of the air conditioner; and defining a cross-sectional area in the range of the cross-sectional area of the fresh air inlet range of the fresh air inlet as the cross-sectional area of the fresh air inlet.

Furthermore, the processor 1001 can be used for calling the network operation control application program stored in the memory 1005, and executing the following operations:

calculating a first cross-sectional area range of the fresh air inlet according to the maximum outputting air volume, the maximum fresh air coefficient, and the minimum fresh air coefficient of the indoor unit of the air conditioner;

calculating a second cross-sectional area range of the fresh air inlet according to the minimum outputting air volume, the maximum fresh air coefficient, and the minimum fresh air coefficient of the indoor unit of the air conditioner;

judging whether there is an intersection area between the first cross-sectional area range of the fresh air inlet and the second cross-sectional area range of the fresh air inlet; and defining the intersection area as the cross-sectional area range of the fresh air inlet when there is an intersection area.

Furthermore, the processor 1001 can be used for calling the network operation control application program stored in the memory 1005, and executing the following operations:

defining both the first cross-sectional area range of the fresh air inlet and the second cross-sectional area range of the fresh air inlet as the cross-sectional area range of the fresh air inlet, when there is no intersection area between the first cross-sectional area range of the fresh air inlet and the second cross-sectional area range of the fresh air inlet.

Furthermore, the processor 1001 can be used for calling the network operation control application program stored in the memory 1005, and executing the following operations:

acquiring an intermediate cross-sectional area of the fresh air inlet from the cross-sectional area range of the fresh air inlet; and defining the intermediate cross-sectional area of the fresh air inlet as the cross-sectional area of the fresh air inlet.

Figure 2:
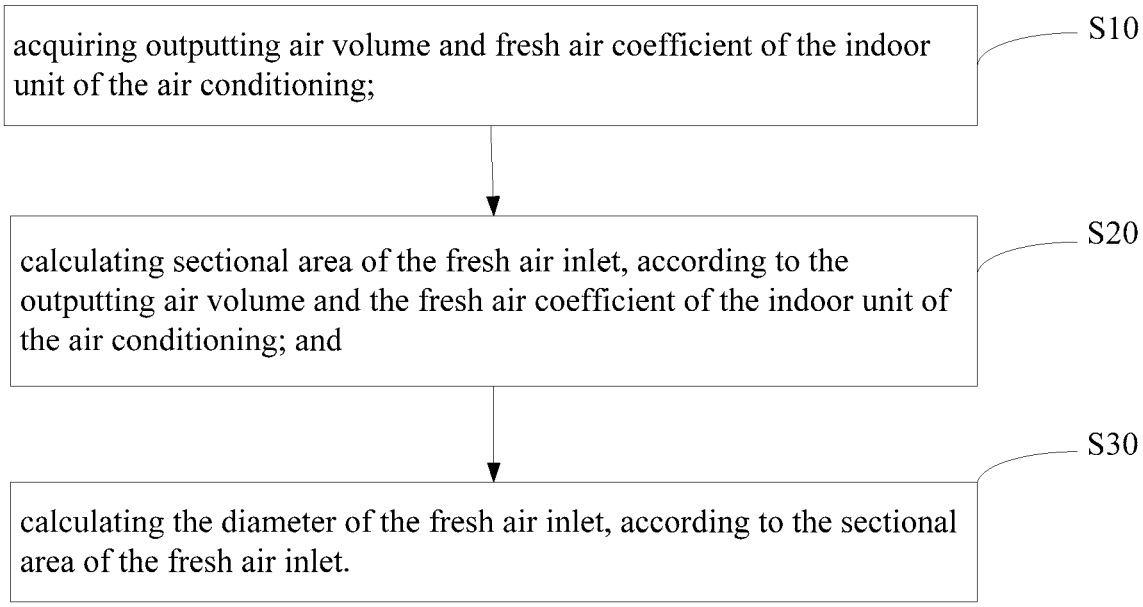
FIG. 2 is a flowchart diagram of method for determining the size of fresh air inlet according to a first exemplary embodiment of the present disclosure.

Referring to FIG. 2, FIG. 2 is a flowchart diagram of method for determining the size of the fresh air inlet according to a first exemplary embodiment of the present disclosure, and the fresh air inlet is a fresh air inlet defined on the indoor unit of the air conditioner and used for bringing fresh air into the indoor room, the fresh air inlet can be connected to the outdoor through pipe, and the outdoor unit can be connected with the indoor unit by the fresh air inlet, so as to continually refresh the indoor fresh air, thus resulting more comfortable indoor environment.

The method for determining the size of the fresh air inlet includes the following steps:

Step S10, acquiring the outputting air volume of the indoor unit of the air conditioner and the fresh air coefficient;

The outputting air volume of the indoor unit of the air conditioner is a designed air volume of the indoor unit of the air conditioner, which can be adjusted according to the actual demand or different customers' requirements.

Figure 3:
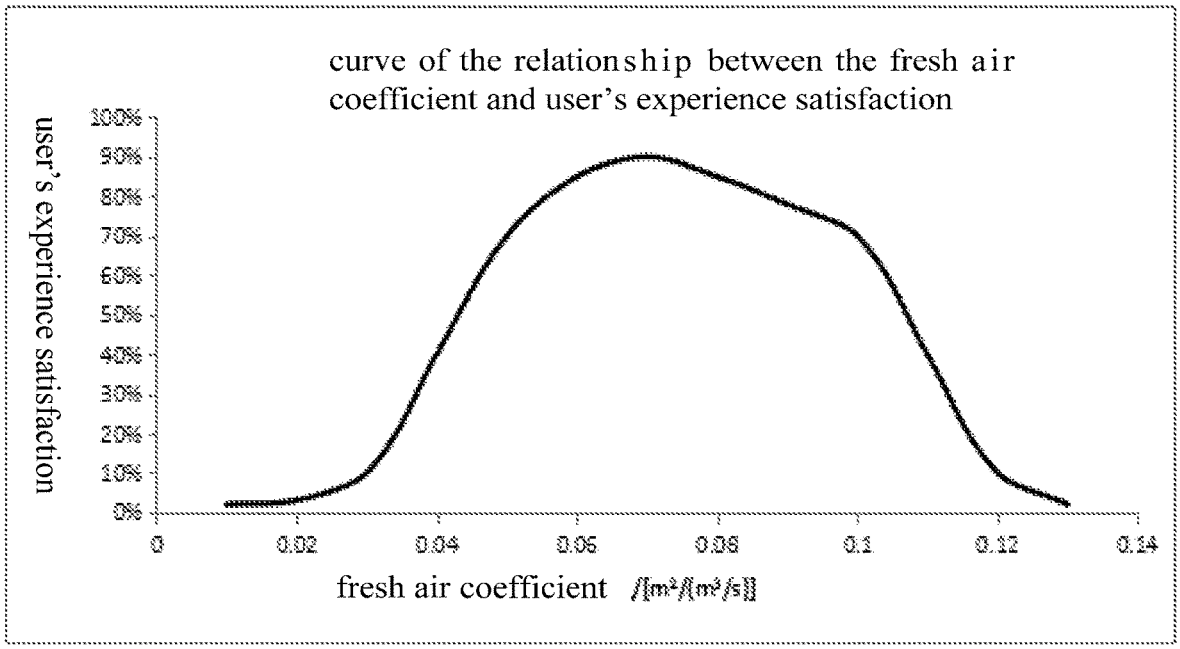
FIG. 3 is a curve graph of the relationship between the fresh air coefficient and user's experience satisfaction.

The fresh air coefficient is a cross-sectional area of the fresh air inlet for bringing in unit air volume of the air conditioner, in the exemplary embodiment, the fresh air coefficient is obtained by researching different fresh air coefficients and user's experience satisfaction through user experience research method, referring to FIG. 3, FIG. 3 is a curve graph of the relationship between the fresh air coefficient and user's experience satisfaction, as user's experience satisfaction can be defined as acceptable criteria, when the user's experience satisfaction reaches to 70 percent, it can determine that the fresh air coefficient is 0.05~0.1 m2/(m3/s), and, the optimum value is 0.07 m2/(m3/s).

Before calculating the size of the fresh air inlet of the indoor unit of the air conditioner, the outputting air volume of the indoor unit of the air conditioner and the fresh air coefficient can be manually inputted, according to the designed air volume of the indoor unit of the air conditioner, or the designed air volume can be determined according to the mode of the indoor unit of the air conditioner, such that the outputting air volume of the indoor unit of the air conditioner can be automatically acquired.

Step S20, calculating a cross-sectional area of the fresh air inlet, according to the outputting air volume and the fresh air coefficient of the indoor unit of the air conditioner;

the cross-sectional area of the fresh air inlet is defined as a cross-sectional area of the fresh air inlet on the indoor unit of the air conditioner, and a required cross-sectional area of the fresh air inlet corresponding to the outputting air volume. The cross-sectional area of the fresh air inlet is calculated, according to the relationship between the cross-sectional area of the fresh air inlet and the outputting air volume of the indoor unit of the air conditioner, and the relationship between the cross-sectional area of the fresh air inlet and the outputting air volume of the indoor unit of the air conditioner is: $A=Q\times C$.

And, A is defined as the cross-sectional area of the fresh air inlet; Q is defined as the outputting air volume of the indoor unit of the air conditioner; C is defined as the fresh air coefficient.

Step S30, calculating a diameter of the fresh air inlet, according to the cross-sectional area of the fresh air inlet.

The diameter of the fresh air inlet is the diameter of the fresh air inlet on the indoor unit of the air conditioner, the diameter of the fresh air inlet is calculated, according to the relationship between the diameter of the fresh air inlet and the cross-sectional area of the fresh air inlet, which is $$d = 2\times\sqrt{\frac{A}{2\cdot\pi}},$$

and d is defined as the diameter of the fresh air inlet.

It is to be understood that, while the outputting air volume of the indoor unit of the air conditioner is a fixed value, the cross-sectional area of the fresh air inlet can be determined directly according to the outputting air volume and the fresh air coefficient, and then the diameter of the fresh air inlet is also determined; while the outputting air volume of the indoor unit of the air conditioner is a variable, the cross-sectional area of the fresh air inlet can be determined according to the median value of the outputting air volume of the indoor unit of the air conditioner and the fresh air coefficient, or the cross-sectional area of the fresh air inlet can be determined according to an average value of the outputting air volume of the indoor unit of the air conditioner and the fresh air coefficient, or the cross-sectional area of the fresh air inlet can be determined according to the maximum value or minimum value of the outputting air volume, and the fresh air coefficient, and then the diameter of the fresh air inlet is determined.

In the exemplary embodiment, the cross-sectional area of the fresh air inlet can be calculated by adopting the outputting air volume of the indoor unit of the air conditioner and the fresh air coefficient, the diameter of the fresh air inlet can be calculated out according to the cross-sectional area of the fresh air inlet, such that the obtained size of the fresh air inlet, the fresh air inlet which is determined according to the above calculating method can maximize satisfy user's requirement of the comfort of the indoor environment. Therefore, forming the fresh air inlet on the indoor unit of the air conditioner can improve the comfort in the indoor environment and user's experience satisfaction without adversely affecting the heat exchange efficiency.

Figure 4:
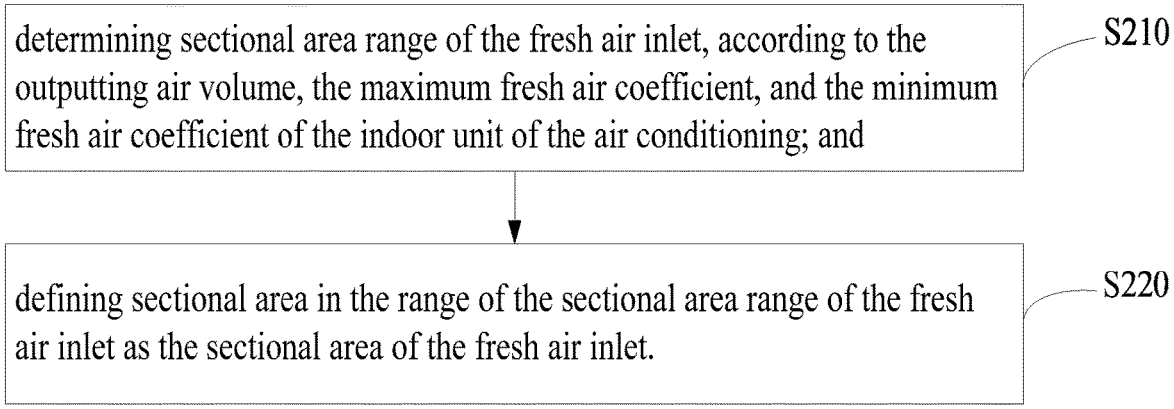
FIG. 4 is a flowchart diagram of method for determining the size of the fresh air inlet according to a second exemplary embodiment of the present disclosure.

Referring to FIG. 4, FIG. 4 is a flowchart diagram of a method for determining the size of the fresh air inlet according to a second exemplary embodiment of the present disclosure, based on the exemplary embodiment shown in FIG. 2, the step S20 of calculating a cross-sectional area of the fresh air inlet, according to the outputting air volume and the fresh air coefficient of the indoor unit of the air conditioner, includes the following steps:

Step S210, determining the cross-sectional area range of the fresh air inlet, according to the outputting air volume, the maximum fresh air coefficient, and the minimum fresh air coefficient of the indoor unit of the air conditioner;

The maximum fresh air coefficient can be a maximum fresh air coefficient in the range corresponding to 70 percent of user's experience satisfaction in the curve of the relationship between the fresh air coefficient and user's experience satisfaction; the minimum fresh air coefficient can be minimum fresh air coefficient in the range corresponding to 70 percent of user's experience satisfaction in the curve of the relation between the fresh air coefficient and user's experience satisfaction. The maximum cross-sectional area of the fresh air inlet is calculated under the outputting air volume of the indoor unit of the air conditioner which adopts the maximum fresh air coefficient, the minimum cross-sectional area of the fresh air inlet is calculated under the outputting air volume of the indoor unit of the air conditioner which adopts the minimum fresh air coefficient, the cross-sectional area range of the fresh air inlet is the range between the maximum cross-sectional area of the fresh air and the minimum cross-sectional area of the fresh air under the outputting air volume.

Step S220, defining a cross-sectional area in the range of the cross-sectional area range of the fresh air inlet as the cross-sectional area of the fresh air inlet.

As there are multiple fresh air coefficients, different fresh air coefficients can be chosen to calculate different cross-sectional areas of the fresh air inlets, and the diameters of different fresh air inlets can be calculated according to the different cross-sectional areas of the fresh air inlets to be set.

In the exemplary embodiment, the cross-sectional area within the cross-sectional area range of the fresh air inlet can be determined according to the usage habit, the cross-sectional area within the cross-sectional area range of the fresh air inlet can also be determined according to the normal size of the pipe that is connected with the fresh air inlet. Alternatively, the cross-sectional area within the cross-sectional area range of the fresh air inlet can also be determined according to the size of the side wall of the return air inlet of the indoor unit of the air conditioner or the setting requirement of the locating of the fresh air inlet, and then the cross-sectional area can be defined as the cross-sectional area of the fresh air inlet. Therefore, it only needs to determine the cross-sectional area within the cross-sectional area range of the fresh air inlet, the requirement of improving the comfort for the indoor environment can be realized, user can choose different size of the fresh air inlets according to the actual need.

In the exemplary embodiment, the cross-sectional area range of the fresh air inlet is determined according to the outputting air volume, the maximum fresh air coefficient and the minimum fresh air coefficient of the indoor unit of the air conditioner. Then the cross-sectional area of the fresh air inlet in the cross-sectional area range of the fresh air inlet is defined as the cross-sectional area of the fresh air inlet. Therefore, it is easy to calculate out the size of the fresh air inlet by the cross-sectional area of the fresh air inlet in the cross-sectional area range of the fresh air inlet, and the cross-sectional area of the fresh air inlet is selected according to the actual size of the indoor unit of the air conditioner or requirement, the cross-sectional area of fresh air inlet with wider using range can be calculated out by this method.

Figure 5:
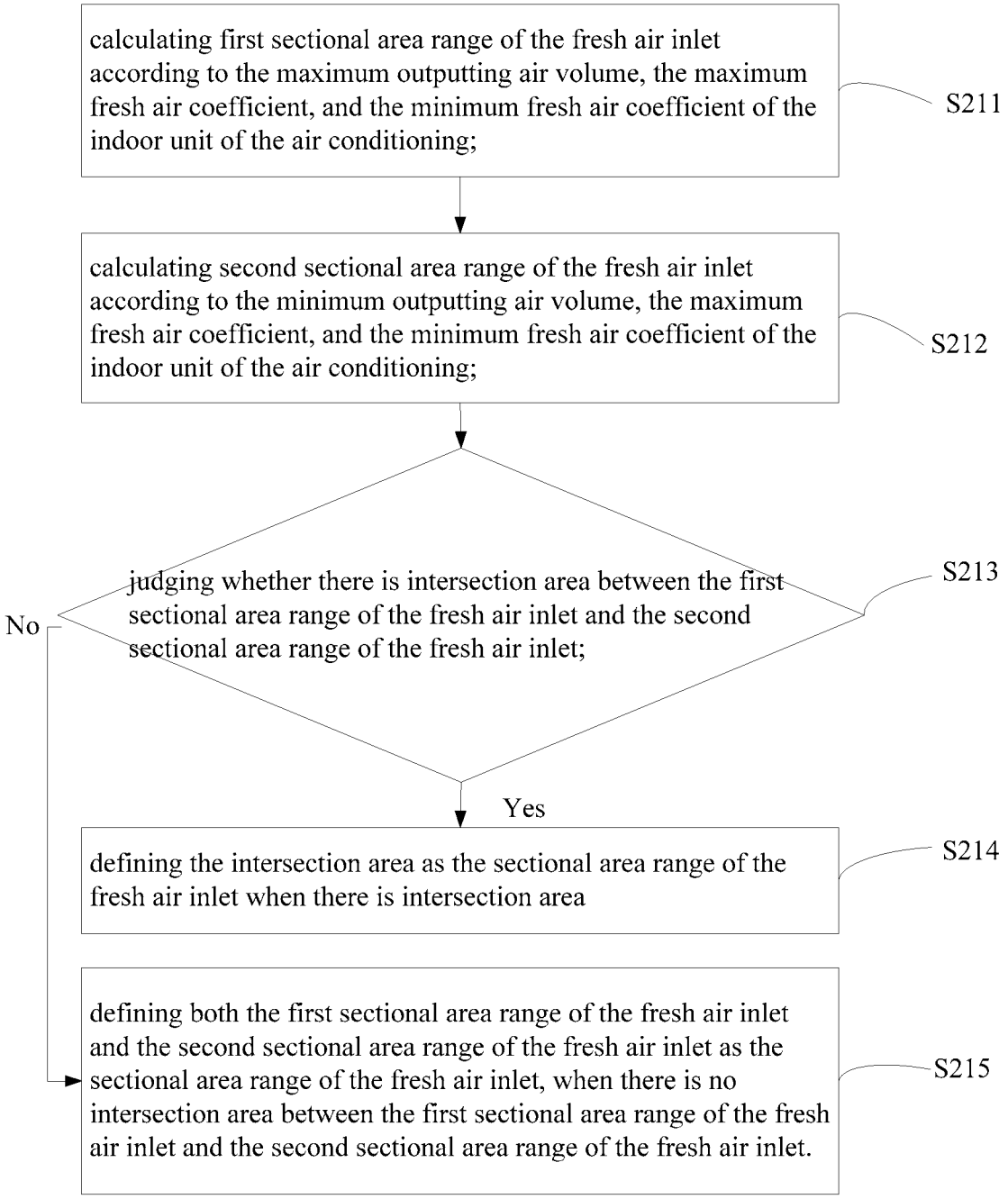
FIG. 5 is a flowchart diagram of method for determining the size of the fresh air inlet according to a third exemplary embodiment of the present disclosure.

Referring to FIG. 5, FIG. 5 is a flowchart diagram of a method for determining the size of the fresh air inlet according to the third exemplary embodiment of the present disclosure, based on the exemplary embodiment shown in FIG. 4, in order to further define the size of the fresh air inlet, and ensure that the calculated size of the fresh air inlet can reach the best refresh effect, the step S210 of that determining the cross-sectional area range of the fresh air inlet, according to the outputting air volume, the maximum fresh air coefficient, and the minimum fresh air coefficient of the indoor unit of the air conditioner includes the following steps:

Step S211, calculating the first cross-sectional area range of the fresh air inlet according to the maximum outputting air volume, the maximum fresh air coefficient, and the minimum fresh air coefficient of the indoor unit of the air conditioner;

Step S212, calculating the second cross-sectional area range of the fresh air inlet according to the minimum outputting air volume, the maximum fresh air coefficient, and the minimum fresh air coefficient of the indoor unit of the air conditioner;

The outputting air volume of the indoor unit of the air conditioner can be adjusted. Therefore, the indoor unit of the air conditioner can have the maximum outputting air volume and the minimum outputting air volume, different giving air quantities can be used for calculating out different cross-sectional areas of the fresh air inlets. Such that, the cross-sectional area range of the fresh air inlet under the maximum outputting air volume can be determined by the maximum outputting air volume, the cross-sectional area range of the fresh air inlet under the minimum outputting air volume can be determined by the minimum outputting air volume.

The maximum cross-sectional area of the fresh air inlet under the maximum outputting air volume can be calculated out by adopting the maximum fresh air coefficient under the maximum outputting air volume of the indoor unit of the air conditioner; the minimum cross-sectional area of the fresh air inlet under the maximum outputting air volume can be calculated out by adopting the minimum fresh air coefficient under the maximum outputting air volume of the indoor unit of the air conditioner, the first cross-sectional area range of the fresh air inlet is the range between the maximum cross-sectional area of the fresh air inlet and the minimum cross-sectional area of the fresh air inlet under the maximum outputting air volume, for example:

the maximum cross-sectional area of the fresh air inlet under the maximum outputting air volume: $A_{max}$ (Max) $=Q_{max}\times C_{max}$;

the minimum cross-sectional area of the fresh air inlet under the maximum outputting air volume: $A_{min}$(Max) $=Q_{max}\times C_{min}$; and the first cross-sectional area range of the fresh air inlet is [$A_{max}$(Max), $A_{min}$(Max)].

The maximum cross-sectional area of the fresh air inlet under the minimum outputting air volume can be calculated out by adopting the maximum fresh air coefficient under the minimum outputting air volume of the indoor unit of the air conditioner; the minimum cross-sectional area of the fresh air inlet under the minimum outputting air volume can be calculated out by adopting the minimum fresh air coefficient under the minimum outputting air volume of the indoor unit of the air conditioner, the second cross-sectional area range of the fresh air inlet is the range between the maximum cross-sectional area of the fresh air inlet and the minimum cross-sectional area of the fresh air inlet under the minimum outputting air volume, for example:

the maximum cross-sectional area of the fresh air inlet under the minimum outputting air volume: $A_{max}$ (Min) $=Q_{min}\times C_{max}$;

the minimum cross-sectional area of the fresh air inlet under the minimum outputting air volume: $A_{min}$(Min) $=Q_{min}\times C_{min}$; and the second cross-sectional area range of the fresh air inlet is [$A_{max}$ (Min), $A_{min}$(Min)].

Step S213, judging whether there is an intersection area between the first cross-sectional area range of the fresh air inlet and the second cross-sectional area range of the fresh air inlet;

whether there is an intersection area between the first cross-sectional area range of the fresh air inlet and the second cross-sectional area range of the fresh air inlet is determined, the intersection area can be determined by analyzing whether there is a repeating region between the first cross-sectional area range of the fresh air inlet and the second cross-sectional area range of the fresh air inlet, and, the repeating cross-sectional area range of the fresh air inlet is the cross-sectional area of the fresh air inlet in the intersection area.

Step S214, defining the intersection area as the cross-sectional area range of the fresh air inlet when there is an intersection area.

If there is an intersection area between the first cross-sectional area range of the fresh air inlet and the second cross-sectional area range of the fresh air inlet, it is determined that the cross-sectional areas of the fresh air inlets in the intersection area can all be appropriate for the fresh air inlets under the maximum outputting air volume and the fresh air inlets under the minimum outputting air volume. Therefore, the intersection area can be defined as the cross-sectional area range of the fresh air inlet, and then the cross-sectional area of the fresh air inlet, which is located in the intersection area and selected according to the requirement or market custom specifications, can be defined as the cross-sectional area of the fresh air inlet.

Step S215, defining both the first cross-sectional area range of the fresh air inlet and the second cross-sectional area range of the fresh air inlet as the cross-sectional area range of the fresh air inlet, when there is no intersection area between the first cross-sectional area range of the fresh air inlet and the second cross-sectional area range of the fresh air inlet.

When there is a large difference between the maximum outputting air volume and the minimum outputting air volume, there is no intersection area between the first cross-sectional area range of the fresh air inlet and the second cross-sectional area range of the fresh air inlet, at this time, the diameter of the fresh air inlet under the maximum outputting air volume cannot be the same with the diameter of the fresh air inlet under the minimum outputting air volume, and the fresh air coefficient cannot be defined in a range of 0.05~0.1 m2/(m3/s). Therefore, different air supply ranges correspond to different fresh air inlets.

One cross-sectional area of the fresh air inlet is selected from the cross-sectional area range of the first fresh air inlet, the diameter of the fresh air inlet corresponding to the maximum outputting air volume is calculated according to the cross-sectional area of the fresh air inlet, so as to obtain the first fresh air inlet. Another one cross-sectional area of the fresh air inlet is selected from the cross-sectional area range of the second fresh air inlet, the diameter of the fresh air inlet corresponding to the minimum outputting air volume is calculated according to the another one cross-sectional area of the fresh air inlet, so as to obtain the second fresh air inlet, the product (the indoor unit of the air conditioner) can be formed with two fresh air inlets having different size (that is the first fresh air inlet and the second fresh air inlet), if a low gear is selected when mounting the product, a pipe is set to connect with the second fresh air inlet, to bring in the fresh air; if a higher gear is selected when mounting the product, a pipe is set to connect with the first fresh air inlet, to bring in the fresh air, such the comfort of user is further improved.

It is to be understood that, in the exemplary embodiment, the outputting air volume can be divided into a plurality of gears according to the air volume from low to high, such as, the first gear air volume, the second gear air volume, the third gear air volume, and so on, when the air volume is divided into several gear air volumes, one cross-sectional area range of the fresh air inlet corresponding to each of the several gear air volumes is calculated according to each of the several gear air volumes, the minimum fresh air coefficient, and the maximum fresh air coefficient, and then the cross-sectional area range of the fresh air inlet can be determined according to intersection areas among the cross-sectional area ranges of the fresh air inlets corresponding to the gear air volumes, so as to determine the cross-sectional area range of the fresh air inlet, when there is an intersection area among the cross-sectional area ranges of the fresh air inlets corresponding to the gear air volumes, the intersection area can be defined as the cross-sectional area of the fresh air inlet, when there is no intersection area among the cross-sectional area ranges of the fresh air inlets corresponding to the gear air volumes, the cross-sectional area range of the fresh air inlet corresponding to each of the gear air volumes can be defined as the cross-sectional area range of the fresh air inlet.

In the exemplary embodiment, the cross-sectional area range of the first fresh air inlet under the maximum outputting air volume and the cross-sectional area range of the second fresh air inlet under the minimum outputting air volume are calculated, and when it is determined that there is one intersection area between the cross-sectional area range of the first fresh air inlet and the cross-sectional area range of the second fresh air inlet, the intersection area can be determined as the cross-sectional area range of the fresh air inlet by calculating. Therefore, the fresh air inlet which is obtained according to the cross-sectional area of the fresh air inlet in the intersection area can be appropriate for the maximum outputting air volume and the minimum outputting air volume, and can provide user a more comfortable experience.

Figure 6:
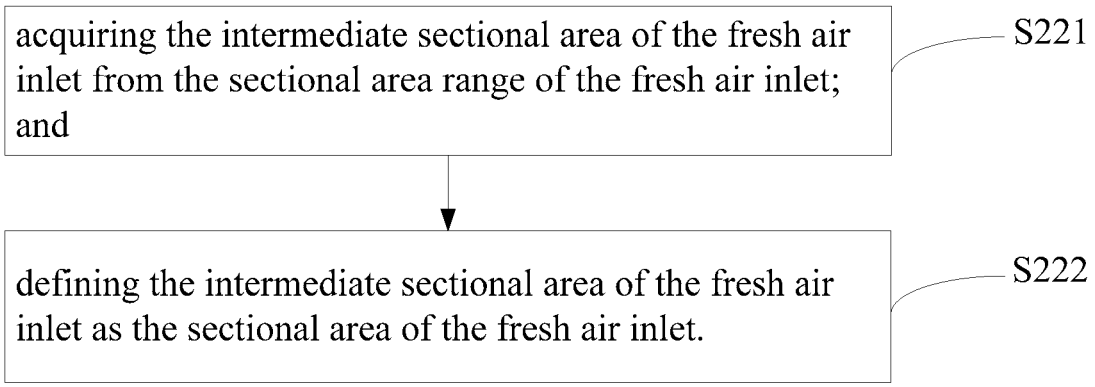
FIG. 6 is a flowchart diagram of method for determining the size of the fresh air inlet according to a fourth exemplary embodiment of the present disclosure.

Referring to FIG. 6, FIG. 6 is a flowchart diagram of a method for determining the size of the fresh air inlet according to a fourth exemplary embodiment of the present disclosure, based on all of the above exemplary embodiments, the step of defining the cross-sectional area within the cross-sectional area range of the fresh air inlet as the cross-sectional area of the fresh air inlet includes the following steps:

Step S221, acquiring an intermediate cross-sectional area of the fresh air inlet from the cross-sectional area range of the fresh air inlet; and the intermediate cross-sectional area of the fresh air inlet is the cross-sectional area of the fresh air inlet located at the middle of the cross-sectional area range of the fresh air inlet.

Step S222, defining the intermediate cross-sectional area of the fresh air inlet as the cross-sectional area of the fresh air inlet.

The intermediate cross-sectional area of the fresh air inlet is selected and used for calculating out the diameter of the fresh air inlet, such ensuring that fresh air inlet obtained by calculating a cross-sectional area of the fresh air inlet is the best fresh air inlet which is appropriate for the maximum outputting air volume and the minimum outputting air volume.

It is to be understood that, the step of defining the cross-sectional area within the cross-sectional area range of the fresh air inlet as the cross-sectional area of the fresh air inlet further includes the following steps: acquiring the average value of the cross-sectional areas of the fresh air inlets in the cross-sectional area range of the fresh air inlet, and determining the average value of the cross-sectional areas of the fresh air inlets in the cross-sectional area range of the fresh air inlet as the cross-sectional area of the fresh air inlet.

It is to be understood that, the cross-sectional area of the fresh air inlet can be selected from the cross-sectional area range of the fresh air inlet according to the market usage habit or the size of the pipe connected with the fresh air inlet, an appropriate cross-sectional area of the fresh air inlet selected from the cross-sectional area range of the fresh air inlet can be defined as the cross-sectional area of the fresh air inlet.

In the exemplary embodiment, the intermediate cross-sectional area of the fresh air inlet in the cross-sectional area range of the fresh air inlet can be acquired according to the median value of the cross-sectional area range of the fresh air inlet, and the intermediate cross-sectional area of the fresh air inlet can be defined as the cross-sectional area of the fresh air inlet, the diameter of the fresh air inlet can be calculated according to the intermediate cross-sectional area of the fresh air inlet in the cross-sectional area range of the fresh air inlet, such that the range of the outputting air volume is much broader.

Figure 7:
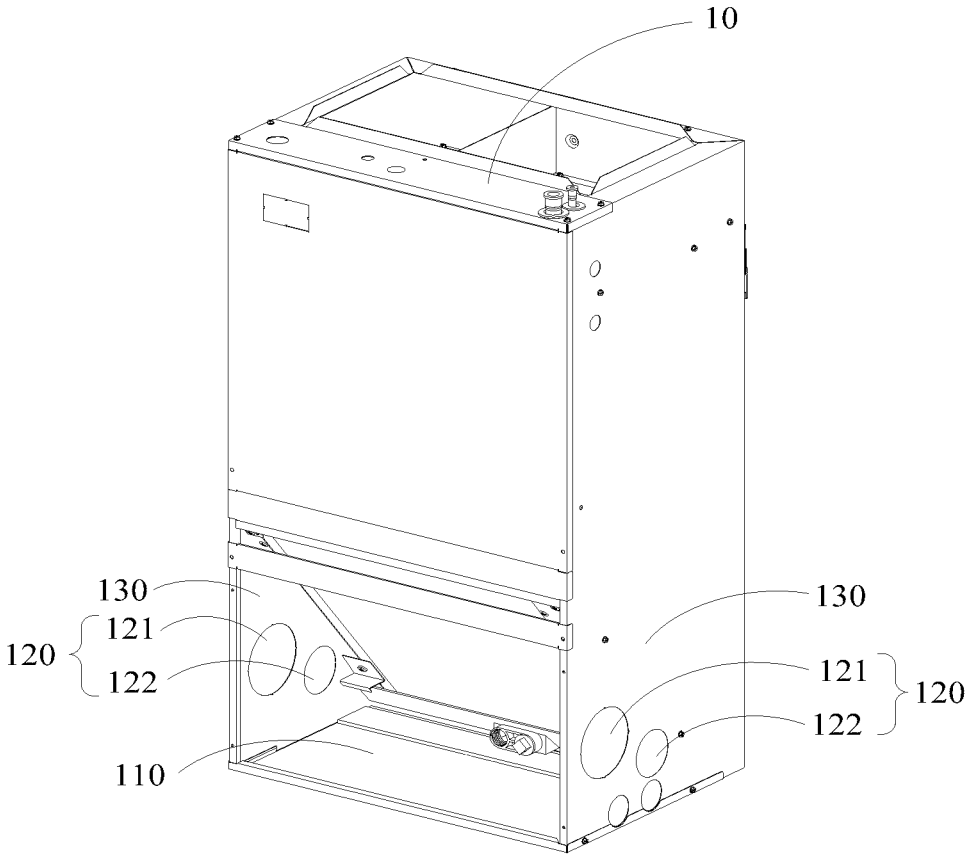
FIG. 7 is a structure diagram of indoor unit of air conditioner according to an exemplary embodiment of the present disclosure.
Figure 8:
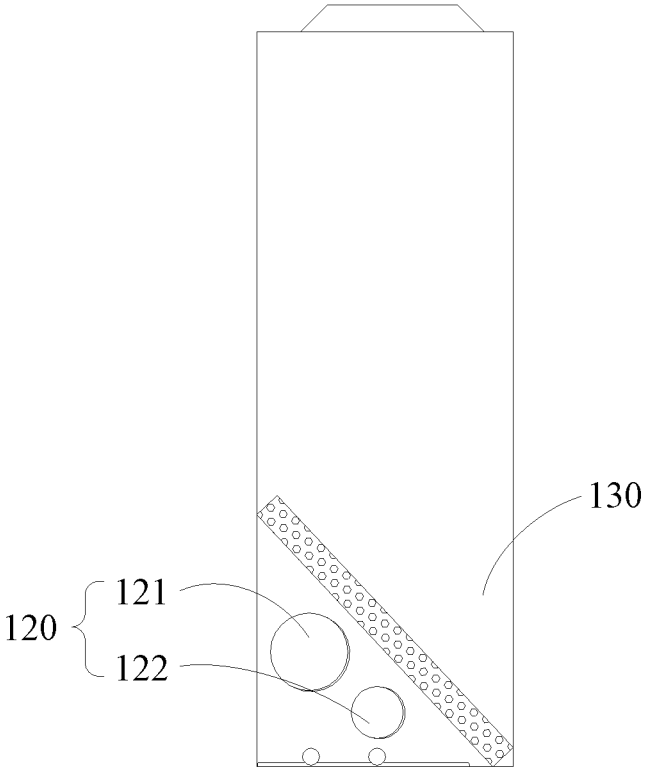
FIG. 8 is a side view diagram of the indoor unit of the air conditioner according to an exemplary embodiment of the present disclosure.

Based on the calculating of the size of the fresh air inlet, the present disclosure also provides an indoor unit of an air conditioner, referring to FIGS. 7-8, the indoor unit of the air conditioner includes: housing 10, the housing 10 has an air outlet (not labelled) and return air inlet 110, the air flows into the indoor unit of the air conditioner through the return air inlet 110 to exchange heat, and is vented from the air outlet after heat exchanging, and then flows into the indoor room through the air outlet, and flows into the indoor unit of the air conditioner again through the return air inlet 110 after mixing with the indoor air, and that cycle repeats to refresh the indoor air, the side wall 130 of the return air inlet 110 defines at least one fresh air inlet 120, the fresh air inlet 120 is connected with the outdoor through pipe, the outdoor air flows into the indoor unit of the air conditioner through the fresh air inlet 120, to mix with the indoor air, thus refreshing the indoor air.

In the exemplary embodiment, the top side, the bottom side, the left side and the right side of the housing 10 are enclosed to form the return air inlet 110 of the housing 10 of the indoor unit of the air conditioner, the fresh air inlet 120 is formed on the left side wall or the right side wall of the return airport of the housing 10. The diameter of the fresh air inlet 120 adopts the diameter calculated out according to the method for calculating the diameter of the fresh air inlet 120, the air inlet volume of the fresh air inlet 120 can not only enable the indoor air to be optimized, but also have no effect on the heat exchange efficiency of the indoor unit of the air conditioner.

Preferably, the indoor unit of the air conditioner further includes one dust-proof component (not labelled) which detachably covers the fresh air inlet 120, before mounting the indoor unit of the air conditioner, the dust-proof member covers the fresh air inlet 120 to prevent dust from entering the fresh air inlet 120. The dust-proof member can be a cover which corresponds to the fresh air inlet 120, the cover is detachably connected with the housing 10, before connecting the pipe with the fresh air inlet 120, the cover can be separated from the housing 10 by knocking, and then the pipe can be connected with the fresh air inlet 120. Or, the dust-proof member can also be a block which is slightly smaller than the fresh air inlet 120, before connecting the pipe with the fresh air inlet 120, the block can be separated from the housing 10 by rotating the block or tool, and then the pipe can be connected with the fresh air inlet 120.

In order to further improve the comfort, and ensure the giving air quantities correspond to the gears, respectively, the side wall 130 of the return airport 110 is formed with a plurality of fresh air inlets 120, the fresh air inlets 120 have different size, and each fresh air inlet 120 corresponds to one gear air volume. Therefore, when different gears are selected, the fresh air inlets 120 can be set up corresponding to the selected gear air volume according the need of the air volume, such that air flowing through corresponding fresh air inlet 120 can reach optimum volume, the indoor environment and user's experience can be improved. In the exemplary embodiment, it is preferable that there are two fresh air inlets 120 having different size, preferably, the diameter of main fresh air inlet 121 can be 6 inch, the diameter of an alternative fresh air inlet 122 can be 4 inch, and the diameters of the main fresh air inlet 121 and the alternative fresh air inlet 122 can be determined according to the market using specification of the pipe and the size design mode of the fresh air inlet 120.

In order to mount the pipe in any direction, two opposite sides 130 of the return airport 110 respectively define the fresh air inlet 120, such that no matter the indoor unit of the air conditioner is mounted at any locations, it does not need to mount the pipe in detour mode.

In the exemplary embodiment of the present disclosure, a new air conditioner can be added in the operating process of the air conditioner by setting the fresh air inlet 120 on the side 130 of the return airport 110 of the indoor unit of the air conditioner, for improving the air quality of the indoor room, then improving user's experience.

Based on the above exemplary embodiment, the present disclosure also provides a device for determining the size of the fresh air inlet, which includes the processor, computer-readable storage medium including the memory, and the computer program stored in the memory and operated by the processor, the computer program when is executed by the processor performs each of the steps of the method for determining the size of the fresh air inlet.

In addition, the present also provides a storage medium, which has stored therein the determining program for determining the size of the fresh air inlet, the determining program for determining the size of the fresh air inlet when is executed by the processor performs the each of the steps of the method for determining the size of the fresh air inlet.

Sequence numbers of the embodiments disclosed herein are meant for the sole purpose of illustrative and do not represent the advantages and disadvantages of these embodiments.

Through the above description of the foregoing embodiments, those skilled in the art can clearly understand that the above methods of the embodiments can be implemented by means of software plus a necessary general hardware platform; they certainly can also be implemented by means of hardware, but in many cases, the former is a better implementation. Based on this understanding, the essential part of the technical solution according to the present disclosure or the part that contributes to the prior art can be embodied in the form of a software product. Computer software products can be stored in a storage medium as described above (e.g., ROM/RAM, a magnetic disk, an optical disc) which includes instructions to cause a terminal device (e.g., a mobile phone, a computer, a server, an air conditioner, a domestic robot, or a network device, etc.) to perform the methods described in the various embodiments of the present disclosure.

It should be appreciated that, throughout this disclosure, the terms "include", "including" or any other variations thereof are intended to compass non-exclusive inclusions, so that a process, method, article, or system that includes a series of elements would include not only those elements, but it may further include other elements that are not explicitly listed or elements that are inherent to such processes, methods, articles, or systems. In the absence of extra limitations, an element defined by the phrase "includes a . . . " does not exclude the presence of additional identical elements in this process, method, article, or system that includes the element.

The foregoing embodiments are merely some illustrative embodiments of the present disclosure, and are not intended to limit the patentable scope of the present disclosure. Any equivalent structural or flow transformations based on the specification and the drawing of the present disclosure, or any direct or indirect applications of the present disclosure in other related technical fields, shall all fall within the protection scope of the present disclosure.

What is claimed is:

1. A method for determining the size of fresh air inlet, the fresh air inlet being a fresh air inlet of indoor unit of air conditioner, the indoor unit of the air conditioner comprising a housing, the housing being defined with an air outlet and return air inlet, air flowing into the indoor unit of the air conditioner from the return air inlet to perform heat exchange, and being vented from the air outlet, side wall of defining the return air inlet defining the fresh air inlet the method comprising:

acquiring an outputting air volume and a fresh air coefficient of the indoor unit of the air conditioner;

calculating a cross-sectional area of the fresh air inlet, according to the outputting air volume and the fresh air coefficient of the indoor unit of the air conditioner; and calculating a diameter of the fresh air inlet, according to the cross-sectional area of the fresh air inlet, wherein the outputting air volume has a dimension of $m^3/s$; and wherein the fresh air coefficient comprises maximum fresh air coefficient and minimum fresh air coefficient, the step of calculating a cross-sectional area of the fresh air inlet according to the outputting air volume and the fresh air coefficient of the indoor unit of the air conditioner comprises:

determining a cross-sectional area range of the fresh air inlet, according to the outputting air volume, the maximum fresh air coefficient, and the minimum fresh air coefficient of the indoor unit of the air conditioner; and defining a cross-sectional area within the cross-sectional area range of the fresh air inlet as the cross-sectional area of the fresh air inlet.

2. The method according to claim 1, wherein the step of defining the cross-sectional area within the cross-sectional area range of the fresh air inlet as the cross-sectional area of the fresh air inlet comprises:

acquiring an intermediate cross-sectional area of the fresh air inlet from the cross-sectional area range of the fresh air inlet; and defining the intermediate cross-sectional area of the fresh air inlet as the cross-sectional area of the fresh air inlet.

3. The method according to claim 1, wherein the outputting air volume comprises maximum outputting air volume and minimum outputting air volume, the step of determining the cross-sectional area range of the fresh air inlet, according to the outputting air volume, the maximum fresh air coefficient, and the minimum fresh air coefficient of the indoor unit of the air conditioner comprises:

calculating a first cross-sectional area range of the fresh air inlet according to the maximum outputting air volume, the maximum fresh air coefficient, and the minimum fresh air coefficient of the indoor unit of the air conditioner;

calculating a second cross-sectional area range of the fresh air inlet according to the minimum outputting air volume, the maximum fresh air coefficient, and the minimum fresh air coefficient of the indoor unit of the air conditioner;

judging whether there is an intersection area between the first cross-sectional area range of the fresh air inlet and the second cross-sectional area range of the fresh air inlet; and defining the intersection area as the cross-sectional area range of the fresh air inlet when there is an intersection area.

4. The method according to claim 3, wherein the step of defining the cross-sectional area within the cross-sectional area range of the fresh air inlet as the cross-sectional area of the fresh air inlet comprises:

acquiring an intermediate cross-sectional area of the fresh air inlet from the cross-sectional area range of the fresh air inlet; and defining the intermediate cross-sectional area of the fresh air inlet as the cross-sectional area of the fresh air inlet.

5. The method according to claim 3, wherein the step of determining the cross-sectional area range of the fresh air inlet, according to the outputting air volume, the maximum fresh air coefficient, and the minimum fresh air coefficient of the indoor unit of the air conditioner further comprises:

defining both the first cross-sectional area range of the fresh air inlet and the second cross-sectional area range of the fresh air inlet as the cross-sectional area range of the fresh air inlet, when there is no intersection area between the first cross-sectional area range of the fresh air inlet and the second cross-sectional area range of the fresh air inlet.

6. The method according to claim 5, wherein the step of defining the cross-sectional area within the cross-sectional area range of the fresh air inlet as the cross-sectional area of the fresh air inlet comprises:

acquiring an intermediate cross-sectional area of the fresh air inlet from the cross-sectional area range of the fresh air inlet; and defining the intermediate cross-sectional area of the fresh air inlet as the cross-sectional area of the fresh air inlet.

7. An indoor unit of an air conditioner, comprising:

a housing, the housing being defined with an air outlet and a return air inlet, air flowing into the indoor unit of the air conditioner from the return air inlet to perform heat exchange, and being vented from the air outlet, a side wall of defining the return air inlet defining at least one fresh air inlet, and a computing device for determining the size of the at least one fresh air inlet, comprising a processor, a computer-readable storage medium, and a computer program which being stored in the computer-readable storage medium and operated by the processor, the computer program performing the following steps of method for determining the size of fresh air inlet when being executed by the processor, to calculate the diameter of the fresh air inlet formed on an indoor unit of an air conditioner:

acquiring an outputting air volume and a fresh air coefficient of the indoor unit of the air conditioner;

calculating a cross-sectional area of the fresh air inlet, according to the outputting air volume and the fresh air coefficient of the indoor unit of the air conditioner; and calculating a diameter of the fresh air inlet, according to the cross-sectional area of the fresh air inlet, the indoor unit of the air conditioner comprising a housing, the housing being defined with an air outlet and return air inlet, air flowing into the indoor unit of the air conditioner from the return air inlet to perform heat exchange, and being vented from the air outlet, side wall of defining the return air inlet defining at least one fresh air inlet, wherein the outputting air volume has a dimension of $m^3/s$, and wherein the fresh air coefficient comprises maximum fresh air coefficient and minimum fresh air coefficient, the step of calculating a cross-sectional area of the fresh air inlet according to the outputting air volume and the fresh air coefficient of the indoor unit of the air conditioner comprises:

determining a cross-sectional area range of the fresh air inlet, according to the outputting air volume, the maximum fresh air coefficient, and the minimum fresh air coefficient of the indoor unit of the air conditioner; and defining a cross-sectional area within the cross-sectional area range of the fresh air inlet as the cross-sectional area of the fresh air inlet.

8. The indoor unit of the air conditioner according to claim 7, wherein the indoor unit of the air conditioner further comprises at least one dust-proof member which detachably covers the fresh air inlet.

9. The indoor unit of the air conditioner according to claim 8, wherein the side wall of defining the return air inlet defines plurality of fresh air inlets, each of the fresh air inlets having a unique size, and two opposite side walls of the return air inlet respectively define the fresh air inlet.

10. A computing device for determining the size of fresh air inlet, comprising a processor, a computer-readable storage medium, and a computer program which being stored in the computer-readable storage medium and operated by the processor, the computer program performing the following steps of method for determining the size of fresh air inlet when being executed by the processor, to calculate the diameter of the fresh air inlet formed on an indoor unit of an air conditioner:

acquiring an outputting air volume and a fresh air coefficient of the indoor unit of the air conditioner;

calculating a cross-sectional area of the fresh air inlet, according to the outputting air volume and the fresh air coefficient of the indoor unit of the air conditioner; and calculating a diameter of the fresh air inlet, according to the cross-sectional area of the fresh air inlet, the indoor unit of the air conditioner comprising a housing, the housing being defined with an air outlet and return air inlet, air flowing into the indoor unit of the air conditioner from the return air inlet to perform heat exchange, and being vented from the air outlet, side wall of defining the return air inlet defining at least one fresh air inlet, wherein the outputting air volume has a dimension of $m^3/s$, and wherein the fresh air coefficient comprises maximum fresh air coefficient and minimum fresh air coefficient, the step of calculating a cross-sectional area of the fresh air inlet according to the outputting air volume and the fresh air coefficient of the indoor unit of the air conditioner comprises:

determining a cross-sectional area range of the fresh air inlet, according to the outputting air volume, the maximum fresh air coefficient, and the minimum fresh air coefficient of the indoor unit of the air conditioner; and defining a cross-sectional area within the cross-sectional area range of the fresh air inlet as the cross-sectional area of the fresh air inlet.

11. The device for determining the size of the fresh air inlet according to claim 10, wherein the step of defining the cross-sectional area within the cross-sectional area range of the fresh air inlet as the cross-sectional area of the fresh air inlet comprises:

acquiring an intermediate cross-sectional area of the fresh air inlet from the cross-sectional area range of the fresh air inlet; and defining the intermediate cross-sectional area of the fresh air inlet as the cross-sectional area of the fresh air inlet.

12. The device for determining the size of the fresh air inlet according to claim 10, wherein the outputting air volume comprises maximum outputting air volume and minimum outputting air volume, the step of determining the cross-sectional area range of the fresh air inlet, according to the outputting air volume, the maximum fresh air coefficient, and the minimum fresh air coefficient of the indoor unit of the air conditioner comprises:

calculating a first cross-sectional area range of the fresh air inlet according to the maximum outputting air volume, the maximum fresh air coefficient, and the minimum fresh air coefficient of the indoor unit of the air conditioner;

calculating a second cross-sectional area range of the fresh air inlet according to the minimum outputting air volume, the maximum fresh air coefficient, and the minimum fresh air coefficient of the indoor unit of the air conditioner;

judging whether there is an intersection area between the first cross-sectional area range of the fresh air inlet and the second cross-sectional area range of the fresh air inlet; and defining the intersection area as the cross-sectional area range of the fresh air inlet when there is an intersection area.

13. The device for determining the size of the fresh air inlet according to claim 12, wherein the step of defining the cross-sectional area within the cross-sectional area range of the fresh air inlet as the cross-sectional area of the fresh air inlet comprises:

acquiring an intermediate cross-sectional area of the fresh air inlet from the cross-sectional area range of the fresh air inlet; and defining the intermediate cross-sectional area of the fresh air inlet as the cross-sectional area of the fresh air inlet.

14. The device for determining the size of the fresh air inlet according to claim 12, wherein the step of determining the cross-sectional area range of the fresh air inlet, according to the outputting air volume, the maximum fresh air coefficient, and the minimum fresh air coefficient of the indoor unit of the air conditioner further comprises:

both the first cross-sectional area range of the fresh air inlet and the second cross-sectional area range of the fresh air inlet are defined as the cross-sectional area range of the fresh air inlet, when there is no intersection area between the first cross-sectional area range of the fresh air inlet and the second cross-sectional area range of the fresh air inlet.

15. The device for determining the size of the fresh air inlet according to claim 14, wherein the step of defining the cross-sectional area within the cross-sectional area range of the fresh air inlet as the cross-sectional area of the fresh air inlet comprises:

acquiring an intermediate cross-sectional area of the fresh air inlet from the cross-sectional area range of the fresh air inlet; and defining the intermediate cross-sectional area of the fresh air inlet as the cross-sectional area of the fresh air inlet.

16. The device for determining the size of the fresh air inlet according to claim 10, wherein the indoor unit of the air conditioner further comprises at least one dust-proof member which detachably covers the fresh air inlet, wherein the dust-proof member is configured to prevent dust from entering the fresh air inlet.

17. The device for determining the size of the fresh air inlet according to claim 16, wherein the side wall of defining the return air inlet defines a plurality of fresh air inlets, each of the fresh air inlets having a unique size, and two opposite side walls of the return air inlet respectively define the fresh air inlet.

* * * * *